US010326212B2

(12) United States Patent
Kim

(10) Patent No.: US 10,326,212 B2
(45) Date of Patent: Jun. 18, 2019

(54) PHASE LAG CELL AND ANTENNA INCLUDING SAME

(71) Applicant: EMW CO., LTD., Incheon (KR)

(72) Inventor: Gi Ho Kim, Gyeonggi-do (KR)

(73) Assignee: EMW CO., LTD., Incheon (KR)

( * ) Notice: Subject to any disclaimer, the term of this patent is extended or adjusted under 35 U.S.C. 154(b) by 297 days.

(21) Appl. No.: 14/893,340

(22) PCT Filed: May 22, 2014

(86) PCT No.: PCT/KR2014/004574
§ 371 (c)(1),
(2) Date: Nov. 23, 2015

(87) PCT Pub. No.: WO2014/193116
PCT Pub. Date: Dec. 4, 2014

(65) Prior Publication Data

US 2016/0111796 A1 Apr. 21, 2016

(30) Foreign Application Priority Data

May 27, 2013 (KR) ..... 10-2013-0059621

(51) Int. Cl.
*H01Q 19/10* (2006.01)
*H01Q 21/29* (2006.01)
(Continued)

(52) U.S. Cl.
CPC ..... *H01Q 21/29* (2013.01); *H01Q 15/24* (2013.01); *H01Q 19/104* (2013.01); *H01Q 19/12* (2013.01); *H01Q 21/0018* (2013.01); *H01Q 21/26* (2013.01)

(58) Field of Classification Search
CPC ..... H01Q 3/005–3/46; H01Q 15/002; H01Q 15/0026; H01Q 15/006; H01Q 15/0066;
(Continued)

(56) References Cited

U.S. PATENT DOCUMENTS 4,342,035 A * 7/1982 Anderson ..... H01Q 11/10 343/755
5,543,809 A * 8/1996 Profera, Jr. ..... H01Q 3/46 343/753
(Continued)

FOREIGN PATENT DOCUMENTS

CN 101714694 A 5/2010
KR 10-2013-0006628 A 1/2013
WO WO 2013/033591 A1 3/2013

OTHER PUBLICATIONS

International Search Report for PCT/KR2014/004574.
(Continued)

*Primary Examiner* — Jessica Han
*Assistant Examiner* — Patrick Holecek
(74) *Attorney, Agent, or Firm* — The PL Law Group, PLLC

(57) ABSTRACT

A phase lag cell and an antenna including the same are disclosed. A phase lag cell according to one embodiment of the present invention comprises: a plane reflector; a substrate spaced apart and positioned at a predetermined distance from the reflector; and a phase lag circuit formed at one side of the substrate such that L-shaped patterns are formed to be vertically and horizontally symmetrical around a cross-shaped slot, and a stub having a predetermined length is extended from the end of each L-shaped pattern.

20 Claims, 7 Drawing Sheets

(51) Int. Cl.

| | |
|---|---|
| ***H01Q 15/24*** | (2006.01) |
| ***H01Q 19/12*** | (2006.01) |
| ***H01Q 21/00*** | (2006.01) |
| ***H01Q 21/26*** | (2006.01) |

(58) Field of Classification Search
CPC .. H01Q 15/0086; H01Q 15/14; H01Q 15/147; H01Q 15/148; H01Q 15/0006–15/248; H01Q 19/10; H01Q 19/108; H01Q 19/12; H01Q 19/13; H01Q 19/005–19/32; H01Q 21/0006–21/30
See application file for complete search history.

(56) References Cited

U.S. PATENT DOCUMENTS

| | | | | |
|---|---|---|---|---|
| 6,081,234 | A | 6/2000 | Huang et al. | |
| 7,605,768 | B2 * | 10/2009 | Ebling ..... | H01Q 1/3233 343/700 MS |
| 2010/0225563 | A1 | 9/2010 | Lin et al. | |
| 2013/0099990 | A1 | 4/2013 | Bresciani et al. | |

OTHER PUBLICATIONS

Ang Yu et al., An X-Band Circularly Polarized Reflectarray Using Split Square Ring Elements and the Modified Element Rotation Technique, IEEE, Antenna and Propagation Society International Symposium, pp. 1-4, 2008.

Garcia-Meca et al., "Low-loss single-layer metamaterial with negative index of refraction at visible wavelengths", Optics Express 9320-9325, vol. 15, No. 15, 2007.

* cited by examiner

PHASE

DISTANCE FROM CENTER OF REFLECTING PLATE(MM)

위상: PHASE

주파수: FREQUENCY

PHASE LAG CELL AND ANTENNA INCLUDING SAME

CROSS REFERENCE TO RELATED APPLICATIONS AND CLAIM OF PRIORITY

This patent application is a National Phase application under 35 U.S.C. § 371 of International Application No. PCT/KR2014/004574, filed May 22, 2014, which claims the priority based on KR 10-2013-0059621 filed May 27, 2013, entire contents of which are incorporated herein by reference.

TECHNICAL FIELD

The present invention relates to a phase lag cell and an antenna including the same, and more particularly, to a phase lag cell capable of compensating for phase differences of reflected waves generated when a parabolic reflector antenna is implemented in a planar shape, and an antenna including the same.

BACKGROUND ART

Parabola antennas are antennas using reflectors having a parabolic shape, and utilize a principle that radio waves radiated toward a reflector having a cross section of a parabola are reflected by the reflector and focused on a focal point or converged in one direction to be intensively radiated. Since such a reflector in the parabolic shape is difficult to be processed and is heavy and large, the reflector has a demerit in that it is difficult to manufacture for portable use. Accordingly, planar antennas, in which a parabolic reflector is replaced with a planar reflecting plate, has been widely used for homes, satellite communications, etc. However, when the parabolic reflector is implemented with the planar reflecting plate, since a distance between a radiation source and each portion of the parabolic reflector and a distance between the radiation source and each portion of the planar reflecting plate are different, phase differences between the reflected waves are generated, and thus, there is a problem in that the directivity of the antenna declines.

FIG. 1 is a view illustrating a reflector of a general parabola antenna, and FIG. 2 is a view illustrating a radiation pattern at a frequency of 8.5 GHz when the reflector of the parabola antenna illustrated in FIG. 1 is used.

As illustrated in FIG. 2, when a parabolic reflector is used, it can be confirmed that an antenna peak gain (dBi) is 23.7 dBi at the frequency of 8.5 GHz, and thus directivity is a significantly high, and radiated power is radiated at 0°.

FIG. 3 is a view illustrating a reflecting plate of a planar antenna when the parabolic reflector illustrated in FIG. 1 is replaced with a planar reflecting plate, and FIG. 4 is a view illustrating a radiation pattern at the frequency of 8.5 GHz when the planar reflecting plate illustrated in FIG. 3 is used.

As illustrated in FIG. 4, when the planar reflecting plate is used, it can be confirmed that an antenna peak gain (dBi) is 8.7 dBi at the frequency of 8.5 GHz, and thus directivity thereof is much worse than that of the parabolic reflector in FIG. 1, and radiated power is radiated as being inclined by 34.0° instead of 0°. As described above, when the parabolic reflector is implemented with the planar reflecting plate, since the distance between the radiation source and the each portion of parabolic reflector and the distance between the radiation source and each portion of the planar reflecting plate are different, the phase differences of the reflected waves are generated.

FIG. 5 is a graph showing phase differences of reflected waves generated when the parabolic reflector is implemented with the planar reflecting plate.

As illustrated in FIG. 5, when the parabolic reflector is implemented with the planar reflecting plate, a difference of a distance between a radiation source and each portion of the parabolic reflector and a distance between the radiation source and each portion of the planar reflecting plate increase in a direction opposite the center of the reflecting plate, and thus, the phase differences of reflected waves increase. Table 1 is a table which represents phase differences in specific values of the reflected waves generated when the parabolic reflector is implemented with the planar reflecting plate.

TABLE 1

| DISTANCE FROM A CENTER OF REFLECTING PLATE (MM) | PHASE DIFFERENCE OF REFLECTED WAVE (°) |
|---|---|
| 0 | 6.428 |
| 18 | −40.48 |
| 36 | −121.732 |
| 54 | −237.328 |
| 72 | −387.268 |
| 90 | −571.552 |
| 108 | −790.18 |

As shown in Table 1, the phase difference of the reflected wave is only about −40° when a distance is about 18 mm from the center of the reflecting plate, but the phase difference of the reflecting plate is about −571° when a distance is about 90 mm from the center of the reflecting plate. Accordingly, the directivity of the planar antenna is greatly lowered due to phase differences of the reflected waves generated when the parabolic reflector is implemented with the planar reflecting plate.

To overcome the above problems, a patch antenna, of which a size and a phase of a resonance element are adjustable and which can be manufactured and integrated easily, is being used, but since the patch antenna has a relatively narrow bandwidth, an adjustable range of the resonance element is limited.

SUMMARY

The present invention is directed to providing a phase lag cell capable of compensating for phase differences of reflected waves generated by adjusting a stub length when a parabolic reflector antenna is implemented with a planar reflecting plate, and an antenna including the same.

One aspect of the present invention provides a phase lag cell including a reflecting plate having a planar shape, a substrate positioned to be spaced apart from the reflecting plate by a predetermined distance, and a phase lag circuit in which L-shaped patterns are formed to be vertically and horizontally symmetrical around a cross-shaped slot, and stubs having a predetermined length are formed on one surface of the substrate to extend from ends of the L-shaped patterns.

Meanwhile, another aspect of the present invention provides an antenna including a reflecting plate having a planar shape, a substrate positioned to be spaced apart from the reflecting plate by a predetermined distance, and a plurality of phase lag circuits in which L-shaped patterns are formed to be vertically and horizontally symmetrical around cross-shaped slots, and stubs having a predetermined length are formed on one surface of the substrate to extend from ends of the L-shaped patterns.

According to an embodiment of the present invention, sequential phase shifts of reflected waves can be performed in a wide range by adjusting stub lengths of a phase lag cell, and thus, a synthesis of the reflected waves can be easily performed.

In addition, since a phase lag circuit according to an embodiment of the present invention has a symmetrical structure, the phase lag circuit can be applied to all of a vertically polarized wave, a horizontally polarized wave, a left-handed circularly polarized wave, and a right-handed circularly polarized wave.

Hereinafter, specific embodiments of the present invention will be described in accordance with the following drawings, however, they are only exemplary embodiments of the invention, and the present invention is not limited thereto.

In descriptions of the invention, when it is determined that detailed descriptions of related well-known functions unnecessarily obscure the essence of the invention, detailed descriptions thereof will be omitted. Some terms described below are defined by considering functions in the invention and meanings may vary depending on, for example, a user or operator's intentions or customs. Therefore, the meanings of terms should be interpreted based on the scope throughout this specification.

The spirit and scope of the invention are defined by the appended claims. The following embodiments are only made to efficiently describe the progressive technological scope of the invention to those skilled in the art.

Figure 1:
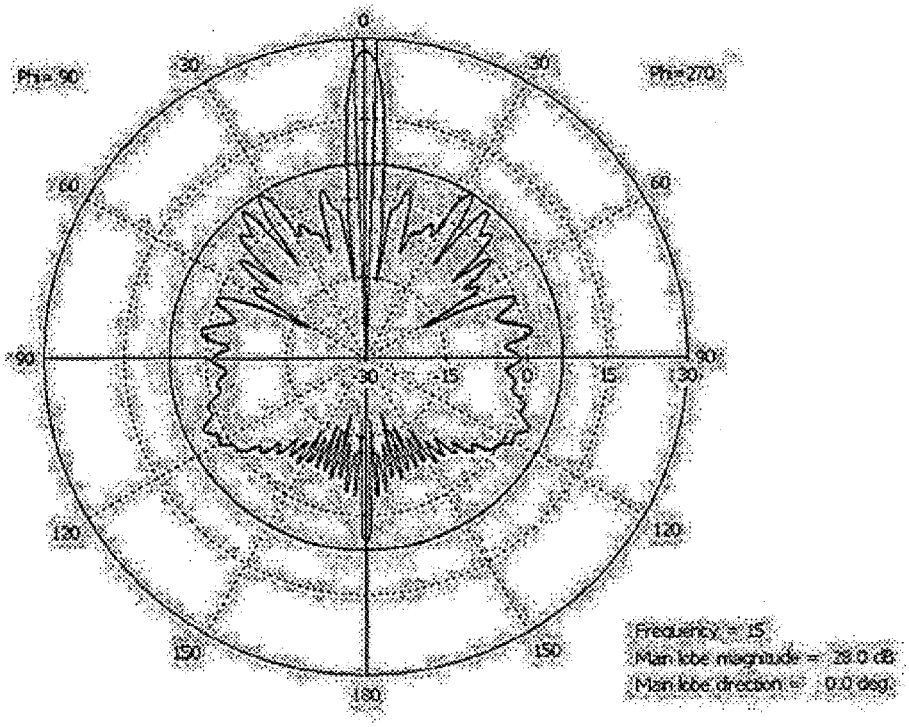
FIG. 1 is a view illustrating a reflector of a general parabola antenna.
Figure 2:
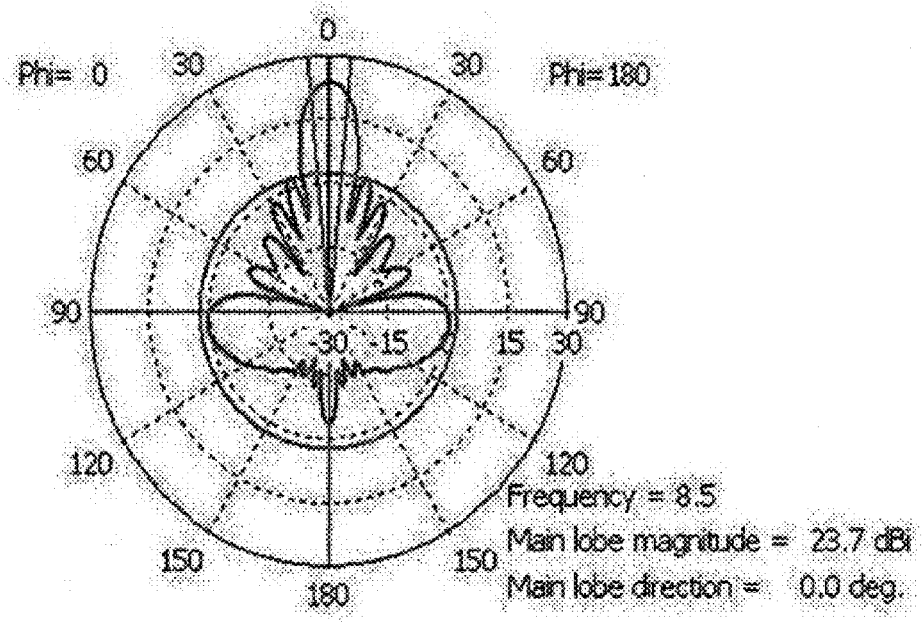
FIG. 2 is a view illustrating a radiation pattern at a frequency of 8.5 GHz when the reflector of the parabola antenna illustrated in FIG. 1 is used.
Figure 3:
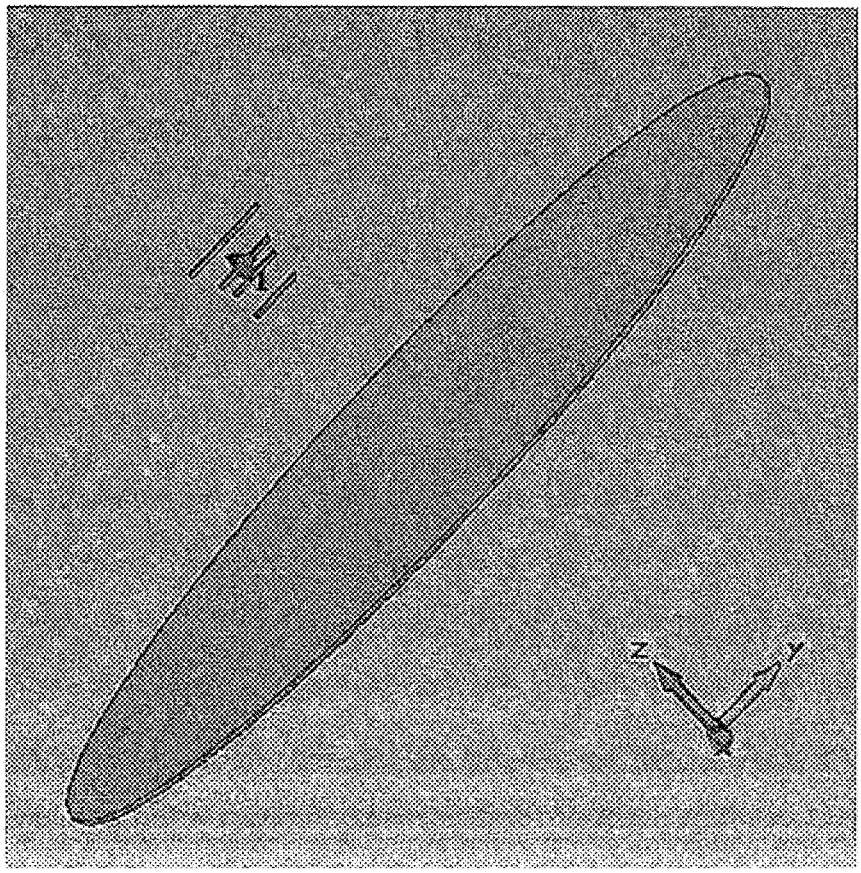
FIG. 3 is a view illustrating a reflecting plate of a planar antenna when the parabolic reflector illustrated in FIG. 1 is replaced with a planar reflecting plate.
Figure 4:
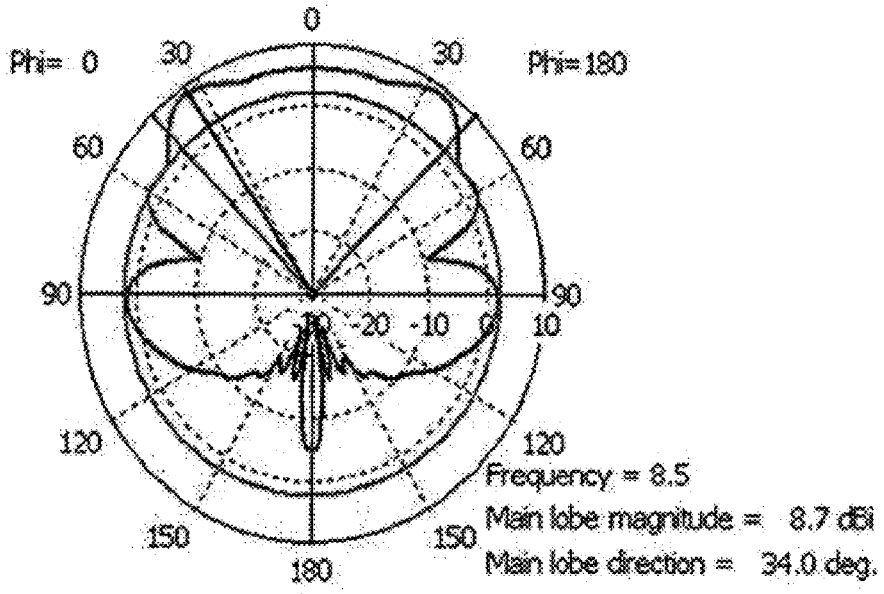
FIG. 4 is a view illustrating a radiation pattern at a frequency of 8.5 GHz when the planar reflecting plate illustrated in FIG. 3 is used.
Figure 5:
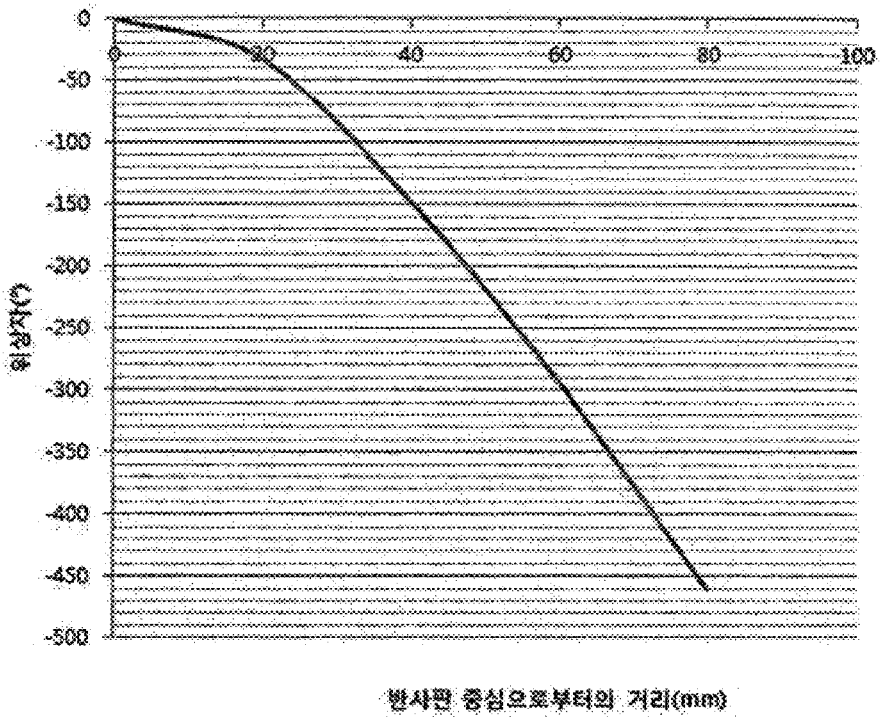
FIG. 5 is a graph showing phase differences of reflected waves generated when the parabolic reflector is implemented with the planar reflecting plate.
Figure 6:
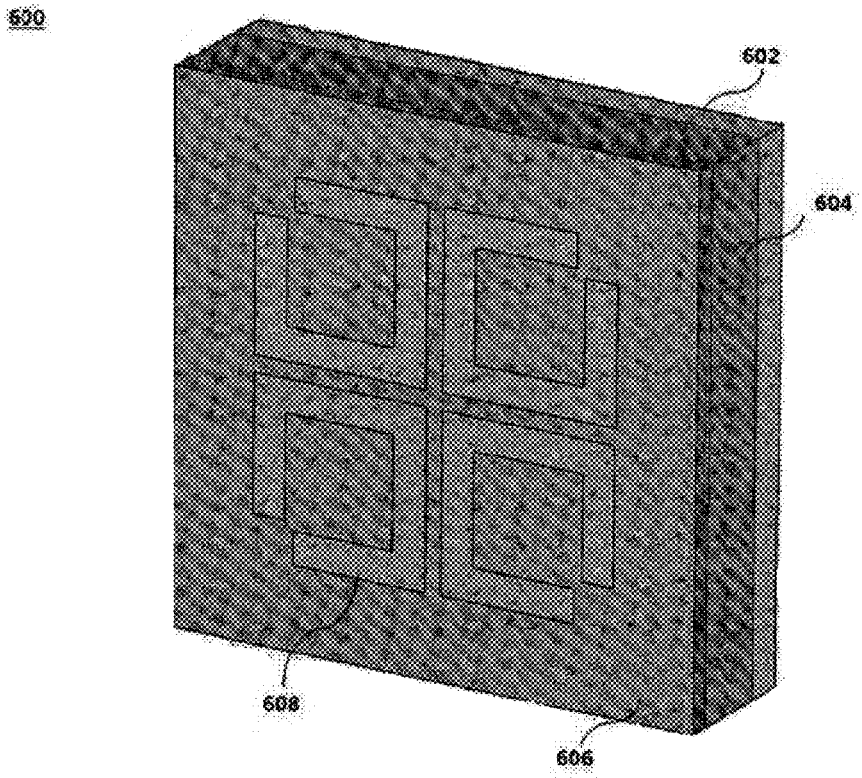
FIG. 6 is a view illustrating a phase lag cell according to an embodiment of the present invention.

FIG. 6 is a view illustrating a phase lag cell according to an embodiment of the present invention. A phase lag cell 600 according to the embodiment of the present invention is a cell for compensating for phase differences of reflected waves generated when a reflector in a parabolic shape is implemented with a reflecting plate in a planar shape, and delays phases of radio waves reflected by the reflecting plate. As illustrated in FIG. 6, the phase lag cell 600 includes a reflecting plate 602, a separating object 604, a substrate 606, and a phase lag circuit 608.

The reflecting plate 602 is formed of a conductive material, and serves as a reflecting object and a ground. The reflecting plate 602 may be formed in various shapes, which have a planar shape of which both ends are not bent, such as a square shape or a circular shape.

The separating object 604 is a material or a structure which separates the reflecting plate 602 from the substrate 606 by a predetermined distance. The substrate 606 may be disposed to have an interval of the predetermined distance from the reflecting plate 602 by the separating object 604, and a distance between the reflecting plate 602 and the substrate 606 may be changed by the sizes of phases of reflected waves. The separating object 604 preferably uses the air or a material having a dielectric constant similar to that of the air to minimize a loss of a reflected wave, but is not limited thereto. The separating object 604 may be, for example, a honeycomb, a foam, a Jig, or the like.

The substrate 606 may be a plate on which the phase lag circuit 608 is formed on one or the other surface thereof, and may be formed in various planar shapes such as a square and a circular shape similar to the reflecting plate 602. The substrate 606 preferably has a shape corresponding to the shape of the reflecting plate 602, but is not limited thereto.

The phase lag circuit 608 may be a circuit configured to compensate for phase differences of reflected waves generated when a parabolic reflector is implemented with a planar reflecting plate, and may be formed on one surface of the substrate 606. Meanwhile, as illustrated in FIG. 6, when the phase lag cell 600 is formed in a square shape, each of a length and a width of the phase lag cell 600 may be, for example, in a range of 0.4λ, to 0.5λ.

Figure 7:
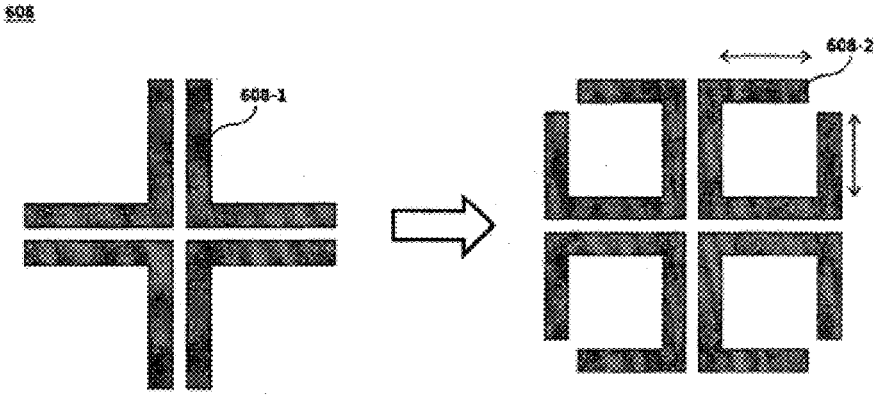
FIG. 7 is a view illustrating a phase lag circuit according to an embodiment of the present invention.

FIG. 7 is a view illustrating a phase lag circuit according to an embodiment of the present invention. As illustrated in FIG. 7, the phase lag circuit 608 according to the embodiment of the present invention has a basic structure in which L-shaped patterns 608-1 are formed to be vertically and horizontally symmetrical around a cross-shaped slot. A thickness of the slot may be in a range of about 0.1λ, to 0.2λ. Since the L-shaped patterns 608-1 are formed to be vertically and horizontally symmetrical around a cross-shaped slot, the phase lag circuit 608 may be applied to all of a vertically polarized wave, a horizontally polarized wave, a left-handed circularly polarized wave, and a right-handed circularly polarized wave.

In addition, the phase lag circuit 608 is formed by extending stubs 608-2 which have a predetermined length from ends of the L-shaped patterns 608-1. According to the embodiment of the present invention, when phases of radio waves reflected by the reflecting plate 602 are delayed, lengths of the stubs 608-2 may be adjusted. At this time, each of the stubs 608-2 included in the phase lag circuit 608 may be adjusted to have a predetermined length, and in addition, the lengths of the stubs 608-2 may also be adjusted to have different lengths. That is, the basic structure in which the L-shaped patterns 608-1 are formed to be vertically and horizontally symmetrical around the cross-shaped slot is maintained, but the lengths of the stubs 608-2 formed at the ends of the L-shaped patterns 608-1 are adjusted, and thus the phases of the reflected waves may be shifted. Through the process of adjusting the lengths of the above-described stubs 608-2, sequential phase shifts of the reflected waves may be performed in a wide range, and thus the reflected waves may be synthesized easily. In addition, the phases of the reflected waves may also be shifted by adjusting widths of the stubs 608-2. As illustrated in FIG. 7, the stubs 608-2 may be formed to extend perpendicular to ends of the L-shaped patterns 608-1, but are not limited thereto, and may be formed to extend to be inclined with respect to the ends of the L-shaped patterns 608-1 at a predetermined angle.

Figure 8:
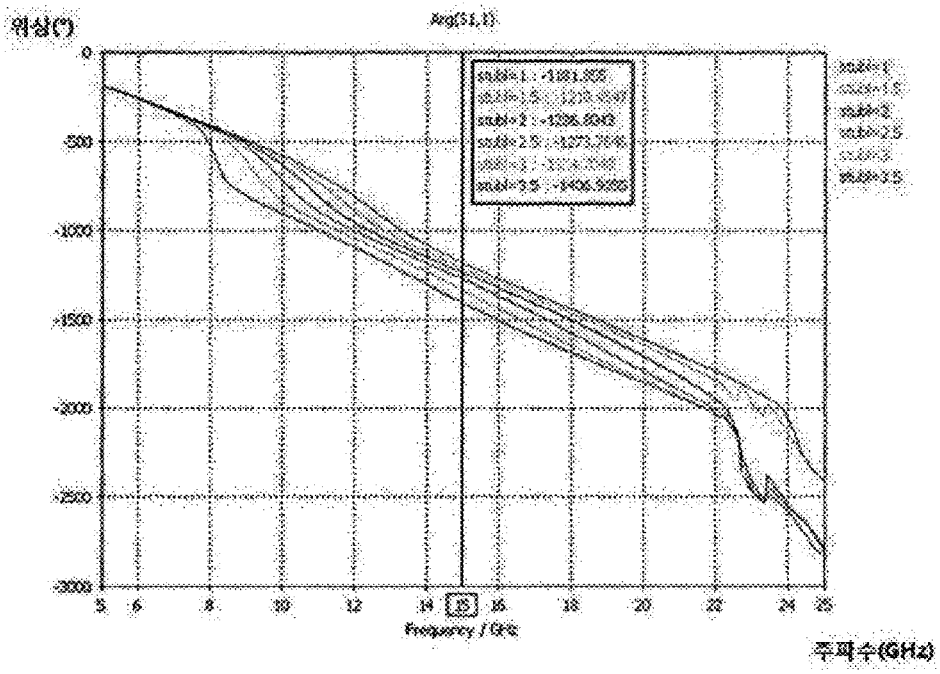
FIG. 8 is a graph showing phases of reflected waves shifted by a change in the length of a stub and a frequency according to an embodiment of the present invention.

FIG. 8 is a graph showing phases of reflected waves shifted by a change in the length of a stub and a frequency according to an embodiment of the present invention.

FIG. 8 shows phase shifts of reflected waves by a change in the frequency when lengths of the stubs 608-2 according to the embodiment of the present invention are 1 mm, 1.5 mm, 2 mm, 2.5 mm, 3 mm, and 3.5 mm. As illustrated in FIG. 8, the phase lag cell 600 according to the embodiment of the present invention shows significant phase shifts of the reflected waves around a specific frequency, for example, a frequency of about 8 GHz. That is, the phase lag cell 600 has a structure having a surface with a magnetic conductor characteristic at the specific frequency, that is, an artificial magnetic conductor (ACM) structure. In addition, since the lengths of the stubs 608-2 according to the embodiment of the present invention are changed, the phases of the reflected waves are shifted by the change in the frequency, and the phase shifts are sequentially performed in a wide range. Accordingly, the phase lag cell 600 according to the embodiment of the present invention has a wider bandwidth for phase shifts compared to a conventional patch antenna, and as the lengths of the stubs 608-2 are adjusted, the sequential phase shifts of the reflected waves in the wide range may be performed.

Figure 9:
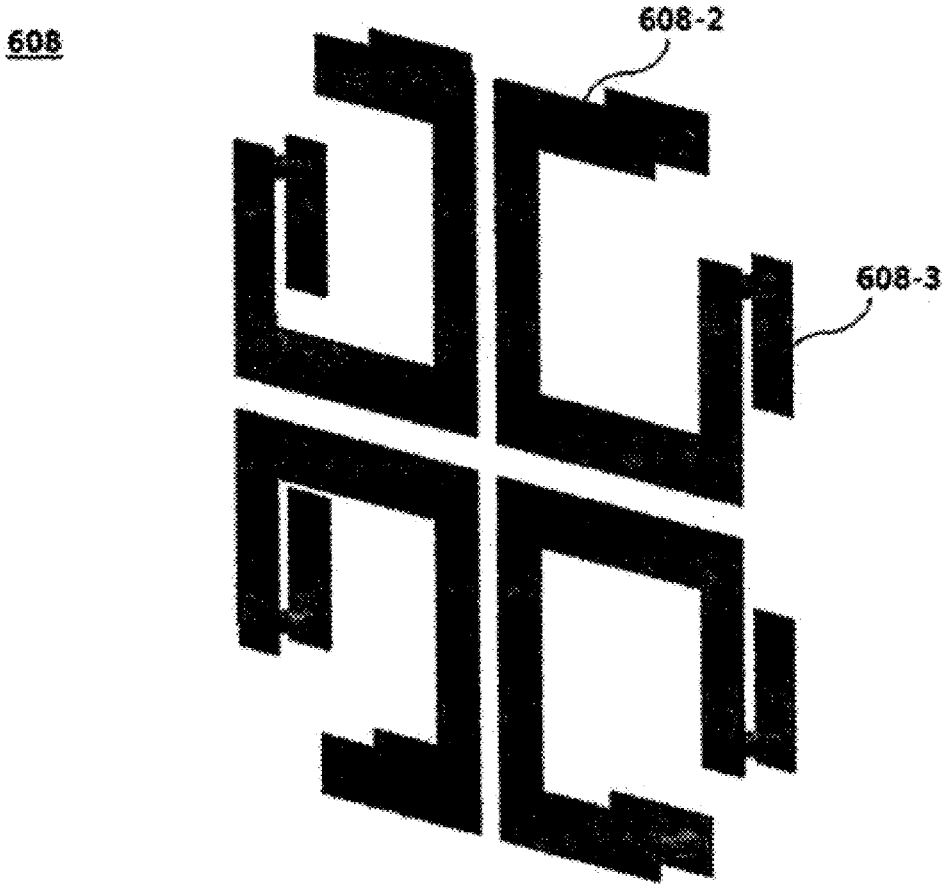
FIG. 9 is a view illustrating a case when the phase lag circuit according to an embodiment of the present invention forms a second stub.

FIG. 9 is a view illustrating a case when the phase lag circuit according to an embodiment of the present invention forms a second stub.

As described above, the stubs 608-2 are formed in the phase lag circuit 608 according to the embodiment of the present invention, and by adjusting the lengths of the stubs 608-2, the phases of the reflected waves may be shifted. In addition, as illustrated in FIG. 9, the phase lag circuit 608 may be formed on the other surface of the substrate 606 to have a predetermined length, and may further include second stubs 608-3 connected to ends of the stubs 608-2 through via holes of the substrate. As illustrated in FIG. 9, the second stubs 608-3 may be formed to extend parallel to the stubs 608-2, but are not limited thereto. According to the embodiment of the present invention, as lengths of the second stubs 608-3 may be adjusted, the sequential phase shifts of the reflected waves may be performed in a narrow range. Here, the lengths of the second stubs 608-3 included in the phase lag circuit 608 may be adjusted to have a predetermined length, and in addition, the lengths of the second stubs 608-3 may also be adjusted to have different lengths. The second stubs 608-3 are for a fine tuning of the phases of the reflected waves, and may more precisely adjust the phases of the reflected waves than the stubs 608-2. For example, when it is assumed that the phase of the reflected wave shifts −20° when the length of the stub 608-2 extends 0.5 mm at the same frequency, when the length of the second stub 608-3 extends 0.5 mm, the phase of the reflected wave may shift −2°. In addition, similar to the stubs 608-2, as the widths of the second stubs 608-3 are adjusted, the phases of the reflected waves may also be shifted. A shape of the second stubs 608-3 is only one embodiment, and the second stubs 608-3 may be formed in various shapes which may precisely shift the phases of the reflected waves.

Figure 10:
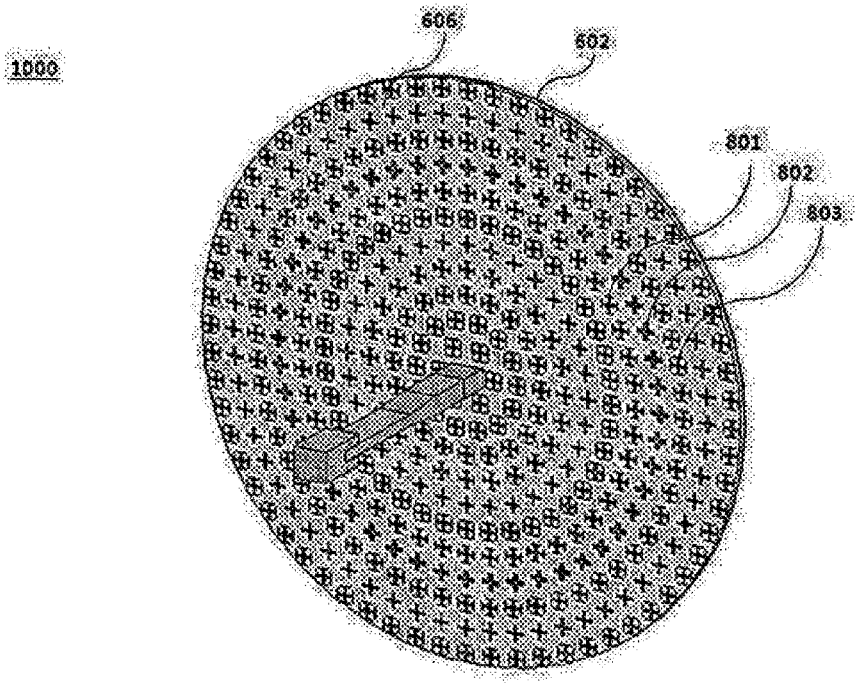
FIG. 10 is a view illustrating an antenna according to an embodiment of the present invention.

FIG. 10 is a view illustrating an antenna according to an embodiment of the present invention. As illustrated in FIG. 10, an antenna 1000 according to the embodiment of the present invention includes a reflecting plate 602, a separating object 604, a substrate 606, and a plurality of phase lag circuits. For the sake of convenience in the description, the plurality of phase lag circuits are described based on an assumption of a first phase lag circuit 801, a second phase lag circuit 802, and a third phase lag circuit 803, and the number of the phase lag circuits is not limited thereto. Since specific descriptions of the reflecting plate 602, the separating object 604, and the substrate 606 according to the embodiment of the present invention are the same as those described above, the specific description herein will be omitted.

As described above, the phase lag circuit according to the embodiment of the present invention is formed so that the L-shaped patterns 608-1 are vertically and horizontally symmetrical around the cross-shaped slots, and the stubs 608-2 having predetermined lengths extend from ends of the L-shaped patterns 608-1, on one surface of the substrate 606. Here, the first phase lag circuit 801, the second phase lag circuit 802, and the third phase lag circuit 803 may be arranged to be spaced apart from each other by a predetermined distance on one surface of the substrate 606, and the arrangement distance of the phase lag circuit may be, for example, in a range of 0.5λ, to 0.8λ. As illustrated in FIG. 10, when the substrate 606 has a circular plane shape, each of the first phase lag circuit 801, the second phase lag circuit 802, and the third phase lag circuit 803 may be arranged around the reflecting plate 602 in a circular shape. The first phase lag circuit 801 may be arranged in a circular shape at a position of 5 mm from the center of the reflecting plate 602, the second phase lag circuit 802 may be arranged in a circular shape at a position of 7 mm from the center of the reflecting plate 602, and the third phase lag circuit 803 may be arranged in a circular shape at a position of 9 mm from the center of the reflecting plate 602.

The stubs having different lengths may be formed in the first phase lag circuit 801, the second phase lag circuit 802, and the third phase lag circuit 803, and the lengths of the stubs are determined according to a degree of delayed phase of a radio wave reflected by the reflecting plate 602. As described above, when the parabolic reflector is implemented with the planar reflecting plate, phase differences of radio waves reflected by the reflecting plate 602 increases in a direction opposite the center of the reflecting plate 602. Accordingly, the first phase lag circuit 801, the second phase lag circuit 802, and the third phase lag circuit 803 respectively having different distances from the center of the reflecting plate 602 may respectively have stubs having different lengths. For example, the first phase lag circuit 801 may be formed by extending the stubs 608-2 to have a length of 0.5 mm from ends of the L-shaped patterns 608-1, the second phase lag circuit 802 may be formed by extending the stubs 608-2 to have a length of 0.6 mm from ends of the L-shaped patterns 608-1, and the third phase lag circuit 803 may be formed by extending the stubs 608-2 to have a length of 0.7 mm from ends of the L-shaped pattern 608-1. Meanwhile, a part of the plurality of phase lag circuits may further include the above-described second stubs 608-3.

That is, according to the embodiment of the present invention, the plurality of phase lag circuits may be arranged to be spaced apart from each other by a predetermined distance on one surface of the substrate 606, and as the lengths of the stubs 608-2 in the phase lag circuit are adjusted according to the positions of the arrangement, phase lags of the reflected waves can be effectively compensated for. However, the above-described method of the arrangement of the phase lag circuits 608 and the lengths of the stubs 608-2 are only one embodiment, but are not limited thereto.

In addition, the antenna 1000 according to the embodiment of the present invention may include at least two phase lag cells, and here, each of the phase lag cells may include a phase lag circuit including lengthwise stubs. Here, as illustrated in FIG. 10, each of the phase lag cells may be arranged in the circular shape, and since the effects according thereto are the same as described above, the description will be omitted.

Figure 11:
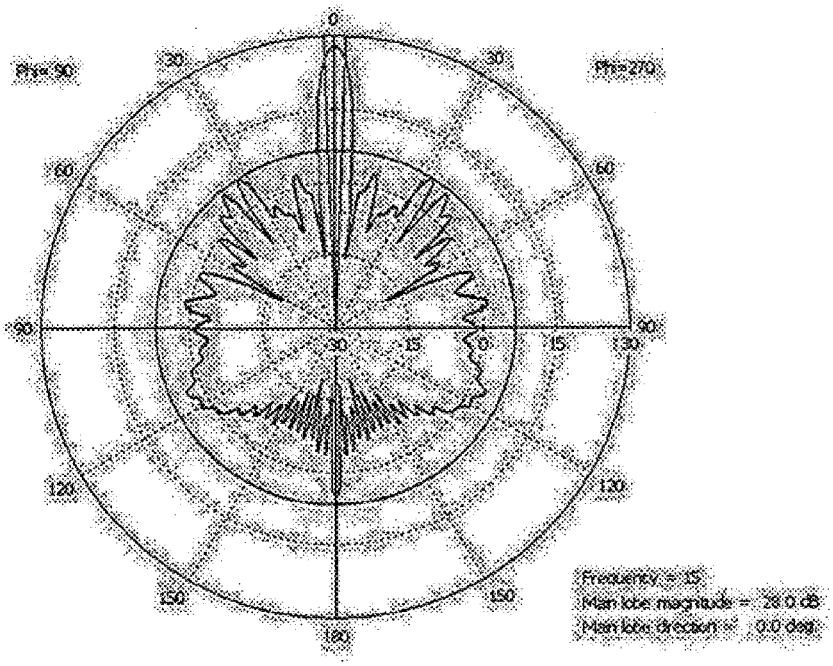
FIG. 11 is a view illustrating a radiation pattern at a frequency of 15 GHz when the phase lag cell of the antenna is used according to an embodiment of the present invention.

FIG. 11 is a view illustrating a radiation pattern at a frequency of 15 GHz when the phase lag cell of the antenna according to an embodiment of the present invention is used.

As illustrated in FIG. 11, when the phase lag cell of the antenna according to the embodiment of the present invention is used, it can be confirmed that an antenna peak gain (dBi) is 28.0 dBi at a frequency of 15 GHz, and thus directivity is significantly high, and a radio power is radiated at 0° similar to the case in which the parabolic reflector of a parabola antenna is used. That is, when the phase lag cell 600 according to the embodiment of the present invention and the antenna 1000 including the same are used, since sequential phase shifts of a wide range may be performed in a wide frequency band, phase differences of reflected waves generated when a parabolic reflector antenna is implemented with a planar reflecting plate may be compensated for, and thus high directivity may be maintained.

While representative embodiments of the preset invention have been described above in detail, it may be understood by those skilled in the art that the embodiments may be variously modified without departing from the scope of the present invention. Therefore, the scope of the present invention is defined not by the described embodiment but by the appended claims, and encompasses equivalents that fall within the scope of the appended claims.

The invention claimed is:

1. A phase lag cell comprising:

a reflecting plate having a planar shape;

a substrate positioned to be spaced apart from the reflecting plate by a predetermined distance; and a phase lag circuit formed on a surface of the substrate, the whole phase lag circuit having a shape as a whole in which L-shaped patterns formed on the surface are formed to be vertically and horizontally symmetrical around a cross-shaped slot, and stubs having a predetermined length are formed on the surface of the substrate to extend from ends of the L-shaped patterns.

2. The phase lag cell of claim 1, wherein the length of the stub is determined according to a degree of delayed phase of a radio wave reflected by the reflecting plate.

3. The phase lag cell of claim 1, wherein the phase lag circuit further includes second stubs formed on the other surface of the substrate to have a predetermined length and connected to ends of the stubs through via holes of the substrate.

4. The phase lag cell of claim 1, further comprising a separating object which separates the reflecting plate from the substrate by a predetermined distance.

5. An antenna comprising at least two of the phase lag cells according to claim 1.

6. An antenna comprising at least two of the phase lag cells according to claim 2.

7. An antenna comprising at least two of the phase lag cells according to claim 3.

8. An antenna comprising at least two of the phase lag cells according to claim 4.

9. The phase lag cell of claim 4, wherein the separating object is air.

10. The phase lag cell of claim 9, wherein the separating object is selected from the group consisting of a honeycomb, a foam and a Jig.

11. The phase lag cell of claim 1, wherein, on the reflecting plate, only one substrate is formed.

12. The phase lag cell of claim 1, wherein each of the L-shaped patterns is a continuously connected shape.

13. An antenna comprising:

a reflecting plate having a planar shape;

a substrate positioned to be spaced apart from the reflecting plate by a predetermined distance; and a phase lag circuit formed on a surface of the substrate, the whole phase lag circuit having a shape as a whole in which L-shaped patterns formed on the surface are formed to be vertically and horizontally symmetrical around a cross-shaped slot, and stubs having a predetermined length are formed on the surface of the substrate to extend from ends of the L-shaped patterns.

14. The antenna of claim 13, wherein the plurality of phase lag circuits are spaced apart from each other by a predetermined distance on the one surface of the substrate.

15. The antenna of claim 13, wherein the length of the stub is determined according to a degree of delayed phase of a radio wave reflected by the reflecting plate.

16. The antenna of claim 13, wherein at least one of the plurality of phase lag circuits further includes second stubs which are formed to have a predetermined length on the other surface of the substrate and are connected to ends of the stubs through via holes of the substrate.

17. The antenna of claim 13, further comprising a separating object which separates the reflecting plate from the substrate by a predetermined distance.

18. The antenna of claim 17, wherein the separating object is air.

19. The antenna of claim 17, wherein the separating object is selected from the group consisting of a honeycomb, a foam and a Jig.

20. The antenna of claim 13, wherein, on the reflecting plate, only one substrate is formed.

* * * * *